United States Patent [19]

Patrichi

[11] 4,054,032

[45] Oct. 18, 1977

[54] EXPLOSIVE ACTUATED PIN PULLER

[75] Inventor: Mihai D. Patrichi, Los Angeles, Calif.

[73] Assignee: Networks Electronic Corporation, Chatsworth, Calif.

[21] Appl. No.: 720,365

[22] Filed: Sept. 3, 1976

[51] Int. Cl.[2] ..... F02N 13/00

[52] U.S. Cl. ..... 60/632; 29/254

[58] Field of Search ..... 29/254, 255; 60/632, 60/633, 634, 635, 636, 637, 638; 92/109

[56] References Cited

U.S. PATENT DOCUMENTS

| | | | |
|---|---|---|---|
| 3,024,592 | 3/1962 | Leaman | 60/637 |
| 3,149,456 | 9/1964 | Sterrett | 60/638 |
| 3,338,553 | 8/1967 | Persicke | 92/109 |
| 3,594,890 | 7/1971 | Cordell | 29/255 |

*Primary Examiner*—James L. Jones, Jr.

[57] ABSTRACT

A pin puller comprising a piston having a pull shaft extending from a cylinder in which the piston is slidable, is actuated by an explosive charge which, when ignited, develops a pressurized gas that is directed, through a transfer tube, into a chamber extending through the piston and into the piston shaft, from which it is directed outwardly through a port in the shaft into a sealed space behind the piston, to move the piston in a direction to exert a pull upon the shaft and a pull-actuated device connected thereto. The piston slidably receives the transfer tube and is sealed thereto to prevent short-circuit escape of the pressurized gas to the leading side of the piston. An electric circuit is provided for igniting the explosive charge when energized.

10 Claims, 1 Drawing Figure

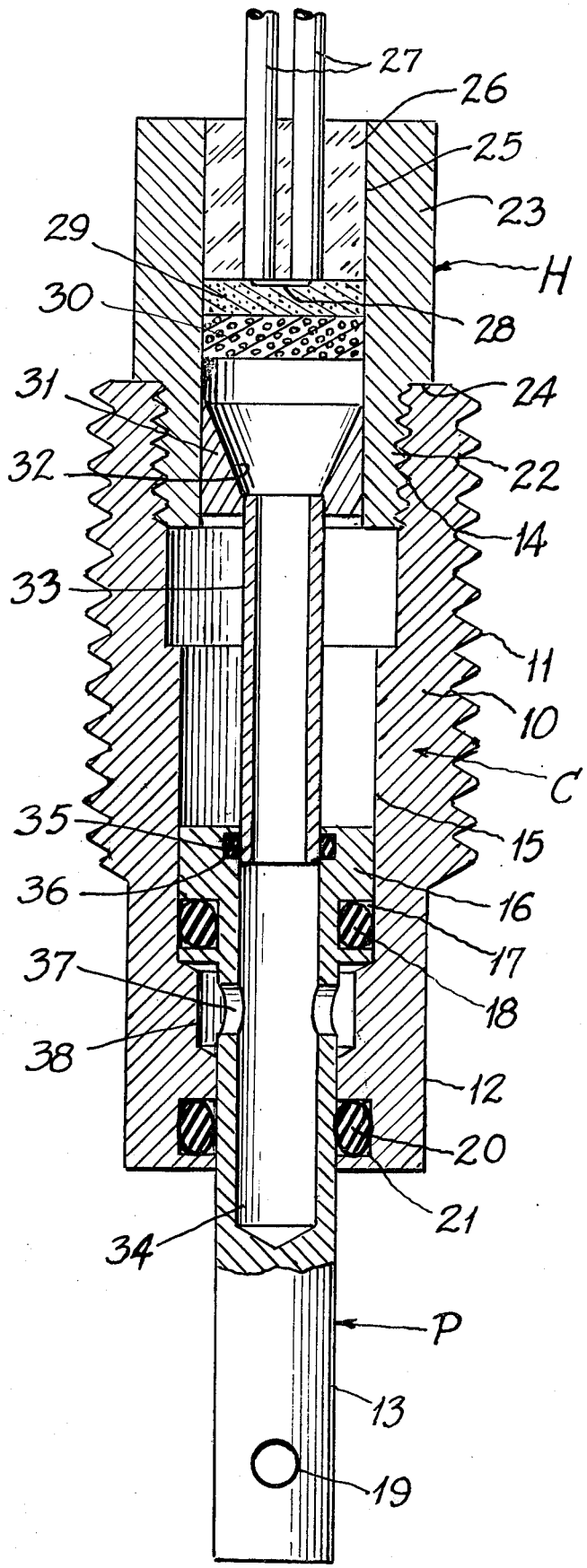
27
26
25
23
H
29
30
28
31
24
32
22
14
33
11
10
C
35
15
36
16
17
37
18
38
12
20
21
34
P
13
19

EXPLOSIVE ACTUATED PIN PULLER

BACKGROUND OF THE INVENTION

Actuators of the pulling type, actuated by an explosive capsule, are disclosed in the following prior art U.S. Pat. Nos.: Leaman 3,024,592, Cordell 3,594,890, Williams 3,893,298. The Leaman patent discloses a pulling device embodying a housing having a cylinder in which a piston with a stem having an axial bore and radial ports for transferring the gases of explosion to the back side of the piston to produce retractive movement resulting in the stem being drawn into the housing. The explosive capsule is mounted in the head of the piston, and the reference does not disclose a transfer tube for directing the explosive gas into the piston. In the present invention, the explosive charge is contained in the cyliner head, thus simplifying the construction.

RESUME' OF THE INVENTION

The invention provides an actuator of singlestroke requirement which is especially designed for embodiment in miniature size, powered by detonation of an explosive charge mounted in the head thereof. A transfer tube, disposed on the axis of the assembly, with one end fixed in and communicating with the cylinder head so as to receive the gas of explosion, and with its other end extending through the piston and into a bore in the piston stem, functions to deliver the gas behind the piston at a point from which the gas will pass through a port in the piston stem so as to act against the rear side of the piston, causing it to draw the stem into the cylinder.

The miniature size and weight of the actuator make it especially suitable for single-stroke actuation of a stage operation in the flight of a missile or outer space vehicle, and its simplicity of construction makes it ideally suitable for operation with no substantial possibility of failure. Also, its detonative operation makes it especially suitable for split-second timing requirement for stage operation of a function of such a vehicle.

The provision of an actuator having such capabilities is the general object of the invention. Other objects will become apparent in the ensuing specifications, in which:

The single FIGURE of the drawing shows, in enlarged proportions, an axial sectional view of an actuator embodying the invention.

DETAILED DESCRIPTION

Referring now to the drawing in detail, I have shown therein, as one example of a form in which the invention may be embodied, a pyrotechnic pin-puller comprising, in general, a housing cylinder C, a header H closing one end of the cylinder, and a piston P slidable axially in the cylinder and having a stem projecting from the other end thereof.

Housing C includes a main body 10 having external threads 11 for mounting it in a missile or other apparatus; and a reduced end portion 12 in which the stem 13 of piston P is sealed for sliding action. Body 10 has an outer end portion into which header H is threaded at 14. A cylindrical bore 15, in the intermediate portion of the housing, extends into reduced end portion 12. The head 16 of piston P is slidable in cylinder bore 15, from an initial position adjacent the rear end of bore 15 as shown, to an inwardly drawn position in which stem 13 is pulled into housing C so as to pull a locking pin or other device from a locking position to a free position in which it will free a part of a missile or other mechanism that has been held in place by the pin.

Piston P has a head 16 which is provided with an annular encircling groove 17 in which an O ring 18 is received, sealing the piston within the bore 15 so as to prevent blowby of the gas of explosion. The outer end of stem 13 is preferably provided with a transverse opening 19 for attachment of the stem to the locking pin to be pulled. Stem 13 is sealed in reduced end position 12 of housing cylinder C by means of an O ring 20 which is contained within an annular internal groove 21 in the outer end of reduced cylinder portion 12.

Header H comprises a neck portion 22 which is threaded at 14 into the outer end of cylinder body 10; and an enlarged head portion 23 defining, at its junction with neck portion 22, an annular shoulder 24 which snugly engages the end of cylinder body 10 so as to substantially seal the header H to housing C. The header has an axial bore 25 in the outer end of which is sealed, with a glass to metal seal, a glass plug 26. A pair of ignition tails 27, extending through plug 26, are connected at their inner ends by a fusible link 28 which, upon application of an ignition current through tails 27, will ignite an ignition charge of explosive material 29. Charge 29 in turn will ignite a main charge of explosive material 30, both charges being in the form of circular cakes, in face to face contact with one another.

Within neck portion 22 of header H is fixed a collar 31 which has a throat 32 tapering inwardly from a maximum diameter substantially the same as that of header bore 25 at its outer end adjacent explosive charge 30, to minimum diameter at its inner endm in which is fixed a transfer tube 33, on the axis of the assembly. Tube 33 extends through cylinder bore 15 and into the open end of an axial bore 34 in piston P, where it is sealed to the piston by an O ring 35 disposed in an internal annular groove 36 within piston head 16. Piston bore 34 extends entirely through piston head 16 and communicates, through one or more ports 37 in the wall of piston stem 13, with an annular pressure chamber 38 surrounding the stem 13 at the rear side of the piston head.

OPERATION

With the pin puller in the inactive state shown in the drawing, it is ready to be activated by an electric current transmitted through connector tails 27. The application of such current will heat the fusible link 28 to a temperature sufficiently high to detonate explosive charge 29, which in turn will ignite the main charge 30, creating a volume of gas sufficient to move piston P from its position shown, to a position drawn into the housing to a point where piston head 16 closely approaches the inner end of header H, and transfer tube 33 is telescoped within bore 34 of piston P. In thus moving the piston, the expanding gas of explosion will be directed from throat 32 through transfer 33 into piston bore 34, the seal ring 35 preventing direct escape of the pressurized gas from the mouth of piston head 16 into cylinder bore 15. From bore 34, the expanding gas will escape through ports 37 into annular chamber 38, and will exert pressure against the back side of piston head 16 so as to move the latter inwardly to a point near the inner end of header neck 22. Escape of the pressurized gas into cylinder bore 15 past the piston head 16 is prevented by O ring 18, and escape of the gas through cylinder end portion 12 along piston rod 13 is prevented by O ring 20.

I claim:

1. An explosive actuated pin puller comprising:

a piston having a head and a stem projecting from the back side thereof, said piston having an axial bore extending through said head and into said stem;

a housing having a chamber in which said head is axially slidable, said stem extending through one end of said housing for axially sliding movement;

a header closing the other end of said housing, said header defining an explosion chamber in its inner end portion;

an explosive charge contained within said header in association with said chamber such as to deliver explosion gases thereto;

an ignition element in igniting association with said charge;

means for energizing said ignition element so as to ignite said explosive charge;

and a transfer tube having one end sealed in said inner end portion of said header and its opposite end sealed in said piston bore;

said housing having a pressure applying chamber at the back side of said piston head, and said piston stem having a port providing communication between its said bore and said chamber;

whereby, upon explosion of said charge, the resulting gas will be directed through said transfer tube into said piston bore and thence through said port into said chamber, so as to apply its pressure to the back side of said piston head and thereby to cause the piston to be drawn into said housing.

2. A pin puller as defined in claim 1, said transfer tube having said one end secured to said header.

3. A pin puller as defined in claim 2, said opposite end of the transfer tube being in slidable telescoping relation to said piston, and an O ring disposed in an internal groove in said piston head and in sliding, sealing engagement with the external surface of said transfer tube.

4. A pin puller as defined in claim 1, said piston head having an external annular groove, and an O ring in said groove, in sealing, sliding engagement with the inernal wall of said housing chamber, said wall being cylindrical.

5. A pin puller as defined in claim 1, said other end of the housing being a neck portion of reduced diameter, said neck portion having an internal annular groove, and an O ring within said groove, said stem extending through said O ring in sliding, sealing engagement therewith.

6. A pin puller as defined in claim 1, said header having a cylindrical bore, said energizing means comprising a pair of ignition tails, a glass plug sealed within the outer portion of said bore, said tails extending through said plug and sealed therein, and a fusible link bridging between the inner ends of said tails and in igniting association with said explosive charge.

7. A pin puller as defined in claim 1, said header having a cylindrical bore, said explosive charge comprising an igniting charge in contact with said ignition element and a main charge in face to face contact with said igniting charge, said charges being in the form of cylindrical cakes disposed in the intermediate region of said bore.

8. A pin puller as defined in claim 1, said explosive charge being disposed in the intermediate region of a cylindrical bore extending axially through said header, and a collar sealed within the inward portion of said bore, said collar defining a throat tapering inwardly from the wall of said bore toward its inward end, said transfer tube being secured in said inward end.

9. A pin puller as defined in claim 1, said housing including a main body portion having external threads for mounting it in a carrying vehicle, said chamber being disposed within said main body portion and being of cylindrical form, said header being threaded into the end of said main body portion.

10. A pin roller as defined in claim 1, said housing including a main body portion having an end into which said header is threaded, and including a neck portion of reduced diameter through which said piston stem is extended for axially sliding movement.

* * * * *